US009466241B2

(12) United States Patent
Jeong et al.

(10) Patent No.: US 9,466,241 B2
(45) Date of Patent: Oct. 11, 2016

(54) ORGANIC LIGHT EMITTING DIODE DISPLAY AND IMAGE COMPENSATION METHOD

(71) Applicant: Samsung Display Co., Ltd., Yongin (KR)

(72) Inventors: Chul-Woo Jeong, Yongin (KR); Soon-Ryong Park, Yongin (KR); Woo-Suk Jung, Yongin (KR); Jung-Ho So, Yongin (KR); Tae-Eun Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 161 days.

(21) Appl. No.: 14/058,628

(22) Filed: Oct. 21, 2013

(65) Prior Publication Data

US 2014/0362126 A1 Dec. 11, 2014

(30) Foreign Application Priority Data

Jun. 11, 2013 (KR) ..... 10-2013-0066798

(51) Int. Cl.
*G09G 3/30* (2006.01)
*G09G 3/32* (2016.01)

(52) U.S. Cl.
CPC .... *G09G 3/3233* (2013.01); *G09G 2310/0262* (2013.01); *G09G 2320/0242* (2013.01); *G09G 2360/145* (2013.01); *G09G 2380/02* (2013.01)

(58) Field of Classification Search
CPC ..... G09G 3/3233; G09G 2310/0262; G09G 2320/0242; G09G 2360/145; G09G 2380/02
USPC ..... 345/76
See application file for complete search history.

(56) References Cited

U.S. PATENT DOCUMENTS

| | | | | |
|---|---|---|---|---|
| 4,635,105 | A * | 1/1987 | Favreau | 348/383 |
| 6,927,908 | B2 * | 8/2005 | Stark | 359/449 |
| 7,663,715 | B2 * | 2/2010 | Jin et al. | 349/73 |
| 8,804,317 | B2 * | 8/2014 | Watanabe | 361/679.06 |
| 2006/0001796 | A1 * | 1/2006 | Chang et al. | 349/95 |
| 2009/0309813 | A1 * | 12/2009 | Fujita | 345/55 |
| 2012/0062447 | A1 * | 3/2012 | Tseng et al. | 345/33 |

FOREIGN PATENT DOCUMENTS

| | | |
|---|---|---|
| KR | 10-2003-0074628 | 9/2003 |
| KR | 10- 2010-0138507 | 12/2010 |
| KR | 10-2011-0133861 | 12/2011 |

* cited by examiner

*Primary Examiner* — Jonathan Boyd
(74) *Attorney, Agent, or Firm* — H.C. Park & Associates, PLC

(57) ABSTRACT

An organic light emitting diode (OLED) display includes a substrate and a display unit. The substrate includes a flat portion and a curved portion. The display unit includes pixels configured to display an image. At least some of the pixels are disposed in association with the flat portion and at least some of the pixels are disposed in association with the curved portion. The display unit includes first driving power lines connected to the pixels disposed in association with the flat portion and second driving power lines connected to the pixels disposed in association with the curved portion. The first driving power lines are configured to transmit a first power source voltage and the second driving power lines are configured to transmit a second power source voltage. The first power source voltage and the second power source voltage are different.

16 Claims, 7 Drawing Sheets

ORGANIC LIGHT EMITTING DIODE DISPLAY AND IMAGE COMPENSATION METHOD

CROSS-REFERENCE TO RELATED APPLICATION

This application claims priority from and the benefit of Korean Patent Application No. 10-2013-0066798, filed on Jun. 11, 2013, which is incorporated by reference for all purposes as if set forth herein.

BACKGROUND

1. Field

Exemplary embodiments relate to an organic light emitting diode (OLED) display. More particularly, exemplary embodiments relate to an OLED display including a curved portion and an image compensating method of the OLED display including the curved portion.

2. Discussion

Conventional OLED displays typically include a pixel circuit and an OLED disposed in association with each pixel area on a substrate. In this manner, such OLED displays are configured to present an image using combinations of light emitted from a plurality of OLEDs. When a polymer film is employed as the substrate, a typical OLED display may be flexible and, thereby, include a combination of shapes, such as a combination of flat portions and curved portions. For example, such an OLED display may include a flat portion and a curved portion connected to at least one edge of the flat portion.

Traditionally, when an OLED display emits white light, the white color of the light observed from a frontal (or perpendicular) perspective may be different from that of light observed from a side (or angled) perspective. White angle difference (WAD) is a metric for evaluating the variation of the white color depending on the viewing angle of an observer. That is, WAD measures and evaluates levels of luminance variations and color coordinate variations with respect to viewing angles and compares such variations with a viewing perspective that is perpendicular to the light source.

Users generally position themselves "front and center" to watch content presented via, for example, an OLED display. If a curved portion of the OLED display is located at an edge of the flat portion, users may perceive light emitted from the flat portion (e.g., frontally-emitted light), as well as light emitted from the curved portion (e.g., laterally-emitted light). As such, light laterally-emitted from the curved portion may have a different white color from light frontally-emitted from the flat portion. This may cause color quality differences. In other words, the color quality of the curved portion observed from a "front and center" viewing position may be different from the color quality of the flat portion.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide an OLED display including a curved portion and a flat portion and an image compensating method thereof that minimizes (or at least reduces) color quality differences between light observed from the flat portion and light observed from the curved portion.

Additional aspects will be set forth in the detailed description which follows and, in part, will be apparent from the disclosure, or may be learned by practice of the inventive concept.

According to exemplary embodiments, an organic light emitting diode (OLED) display includes: a substrate and a display unit. The substrate includes a flat portion and a curved portion. The display unit includes pixels configured to display an image. At least some of the pixels are disposed in association with the flat portion and at least some of the pixels are disposed in association with the curved portion. The display unit includes first driving power lines connected to the pixels disposed in association with the flat portion and second driving power lines connected to the pixels disposed in association with the curved portion. The first driving power lines are configured to transmit a first power source voltage and the second driving power lines are configured to transmit a second power source voltage. The first power source voltage and the second power source voltage are different.

According to exemplary embodiments, an image compensating method, includes: determining color coordinate correction information for a first pixel disposed in association with a curved portion of a display device to equalize lateral color coordinates of the first pixel with frontal color coordinates of a second pixel disposed in association with a flat portion of the display device; supplying a first power source voltage to the second pixel; and supplying a second power source voltage to the first pixel based on the color coordinate correction information. The first power source voltage and the second power source voltage are different.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept and are incorporated in and constitute a part of this specification, illustrate exemplary embodiments of the inventive concept, and together with the description serve to explain the principles of the inventive concept.

DETAILED DESCRIPTION OF THE ILLUSTRATED EMBODIMENTS

Figure 1:
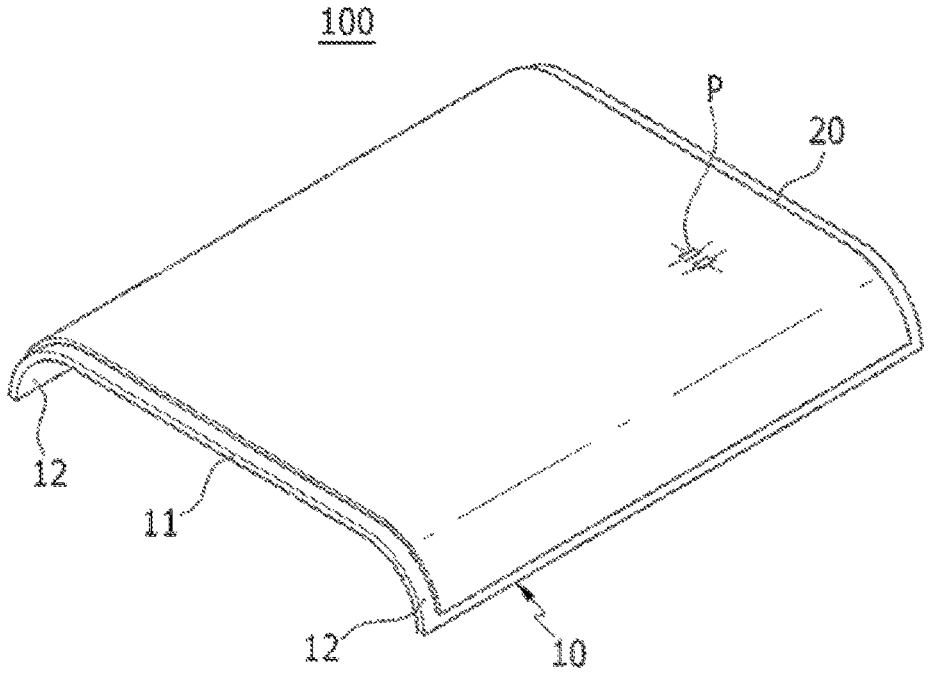
FIG. 1 is a perspective view of an organic light emitting diode (OLED) display, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
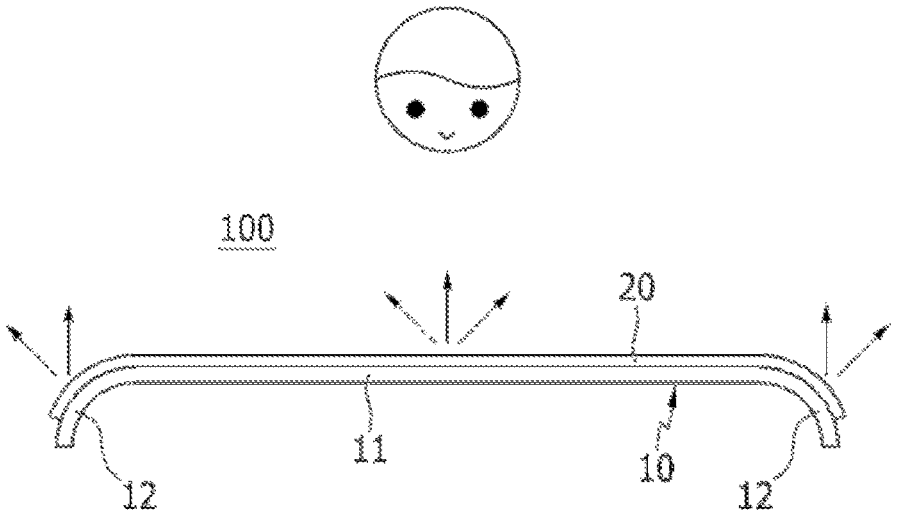
FIG. 2 is a cross-sectional view of the OLED display of FIG. 1, according to exemplary embodiments.

FIGS. 1 and 2 are respective perspective and cross-sectional views of an organic light emitting diode (OLED) display, according to exemplary embodiments.

As seen in FIGS. 1 and 2, the OLED display 100 includes a substrate 10 and a display unit 20 disposed on the substrate 10. The display unit 20 includes a plurality of pixels P configured to display an image. The substrate 10 may be manufactured from any suitable flexible material, such as, for example, a polymer film, a metal-foil, and/or the like. At least a part of the substrate 10 may be bent to form a curved portion 12. In this manner, the substrate 10 may also include a flat portion 11 from which the curved portion 12 extends, e.g., contiguously-extends. For example, the substrate 10 may include the flat portion 11 and a pair of curved portions 12 respectively disposed at a left side and a right side, an upper side and a lower side, or a first side and a second side of the flat portion 11.

According to exemplary embodiments, the curved portions 12 may have the same curvature. As such, the respective centers of curvature of the curved portions 12 may be located at the same side of the display unit 20. It is contemplated, however, that the curved portions may be formed differently. As seen in FIGS. 1 and 2, the curved portions 12 are bent towards substrate 10, and, thereby, away from an observer. In this manner, the display unit 20 is bent in correspondence with the substrate 10. The pixels P are formed on the substrate 10 in, for instance, a matrix pattern. In this manner, each pixel P is configured to emit light for displaying an image. Each of the pixels P may include a pixel circuit and an OLED. Light emission of the OLED may be controlled, at least in part, by the pixel circuit. The configuration of the pixel circuit and the OLED is described in more detail in association with FIGS. 4, 5A, and 5B.

In exemplary embodiments, the display unit 20 may be covered and sealed by a thin-film encapsulation layer (not shown). The thin-film encapsulation layer may suppress deterioration of the OLED caused by, for instance, moisture, oxygen in the ambient environment, debris, etc. The display unit 20 and the thin-film encapsulation layer may be disposed on the top surface or the bottom surface of the substrate 10. When the display unit 20 and the thin-film encapsulation layer are disposed on the top surface of the substrate 10, the OLED display may be referred to as a top light emission type display. When the display unit 20 and the thin-film encapsulation layer are disposed on the bottom surface of the substrate 10, the OLED display may be referred to as a bottom light emission type display. FIGS. 1 and 2 illustrate an exemplary top light emission type display.

Adverting to FIG. 2, the eyes of an observer are located "front and center" with respect to the display unit 20. Since the curve portion 12 is bent with a curvature at an edge of the flat portion 11, the observer may perceive light emitted from the flat portion 11 from a normal viewpoint, as well as perceive light emitted from the curved portion 12 from a lateral (or angled) viewpoint. As such, the OLED display 100 is configured to equalize the white color of light emitted laterally from the curved portions 12 and normally from the flat portion 11. That is, the OLED display 100 is configured to perform a color coordinate correcting operation for pixels located in the curved portion 12. The color coordinate correcting operation may be performed to enable provision of a corrected power source voltage to a driving power line of the curved portion 12 and a corrected data voltage to a data line of the curved portion 12. The color coordinate correcting operation may be performed as part of manufacturing/quality testing the OLED display 100 and/or by users via one or more interfaces of or to the OLED display 100.

Figure 3:
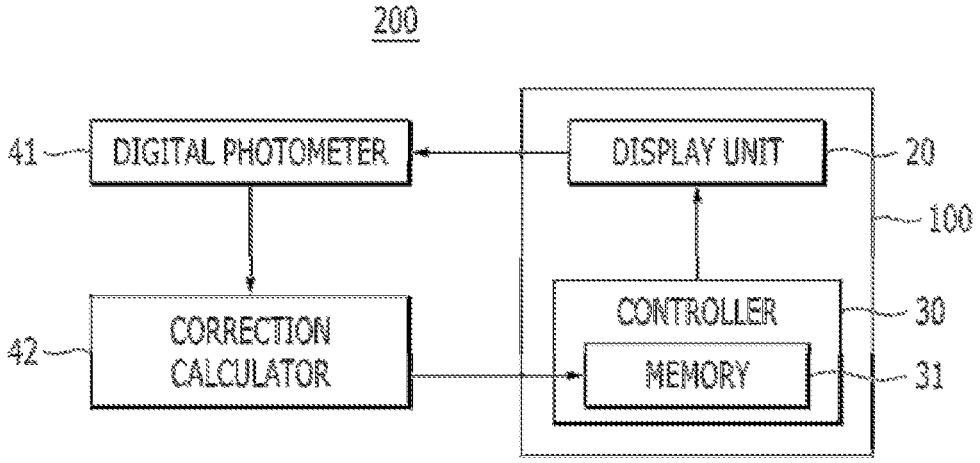
FIG. 3 is a block diagram of a color coordinate correcting system, according to exemplary embodiments.

FIG. 3 is a block diagram of a color coordinate correcting system, according to exemplary embodiments.

Referring to FIG. 3, the color coordinate correcting system 200 includes the OLED display 100, a digital photometer 41, and a correction calculator 42. The digital photometer 41 is configured to measure "frontal" color coordinates and "lateral" color coordinates of pixels disposed in the flat portion 11. The correction calculator 42 is configured to calculate (or otherwise determine) color coordinate correction information for pixels disposed in a curved portion 12. It is contemplated, however, that color coordinate correction information may also be determined for pixels disposed in the flat portion 11. A lateral color coordinate set indicates color coordinates measured at a viewing angle. For example, a lateral color coordinate set may be measured at a 45° viewing angle.

According to exemplary embodiments, the OLED display 100 includes at least one memory 31 configured to store first values of color coordinate data, a controller 30 configured to perform a control operation, and the display unit 20 configured to display images in response to one or more signals received from the controller 30. As described above, the display unit 20 includes a plurality of pixels P formed in the flat portion 11 and the curved portions 12 that may emit light for the display of an image.

The digital photometer 41 is configured to photograph the pixels P disposed in the flat portion 11 at a normal viewpoint (e.g., at a viewing angle of 0°) and at an angled viewpoint (e.g., at a viewing angle of, for instance, 45°) to respectively measure "frontal" color coordinates and "lateral" color coordinates of the pixels P disposed in the flat portion 11. In exemplary embodiments, "lateral" color coordinates of the pixels P disposed in the flat portion 11 may be determined at a plurality of angled viewpoints to mimic (or otherwise approximate) the curvature of the curved portions 12. The measured "frontal" and "lateral" color coordinates may be transmitted to the correction calculator 42 to be analyzed. For instance, using the "frontal" and "lateral" color coordinate information obtained via the digital photometer 41, the correction calculator 42 may be configured to calculate (or otherwise determine) color coordinate correction information for the pixels P disposed in the curved portions 12, which may be utilized to equalize the "lateral" color coordinates of the pixels P disposed in the curved portion 12 with the "frontal" color coordinates of the pixels P disposed in the flat portion 11. The color coordinate correction information determined by the correction calculator 42 may be transmitted to and stored in the memory 31.

As an aside, it is noted that as the voltage supplied to a pixel P is increased, the density of current flowing in the pixel P may also be increased, such as logarithmically increased. The color coordinates of light emitted from a pixel P may be adjusted according to the density of the current flowing in the pixel P. As such, the voltage supplied to the pixels P disposed in the curved portions 12 may be controlled based on the information stored in memory 31 to equalize the color coordinates of the pixels P disposed in the curved portions 12 with the color coordinates of the pixels P disposed in the flat portion 11.

According to exemplary embodiments, the color coordinate correction information stored in the memory 31 may be current-voltage-color coordinate relative function values for a power source voltage or may be current-voltage-color coordinate relative function values for a power source voltage and a data voltage.

In exemplary embodiments, the controller 30, the digital photometer 41, the correction calculator 42, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

As such, one or more of the features, functions, and/or processes described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the controller 30, the digital photometer 41, the correction calculator 42, and/or one or more components thereof may include or otherwise be associated with one or more memories (e.g., memory 31) including code (e.g., instructions) configured to cause the controller 30, the digital photometer 41, the correction calculator 42, and/or one or more components thereof to perform one or more of the features, functions, and/or processes described herein.

The memories, such as memory 31, may be any medium that participates in providing code/instructions to the one or more software, hardware, and/or firmware components for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Figure 4:
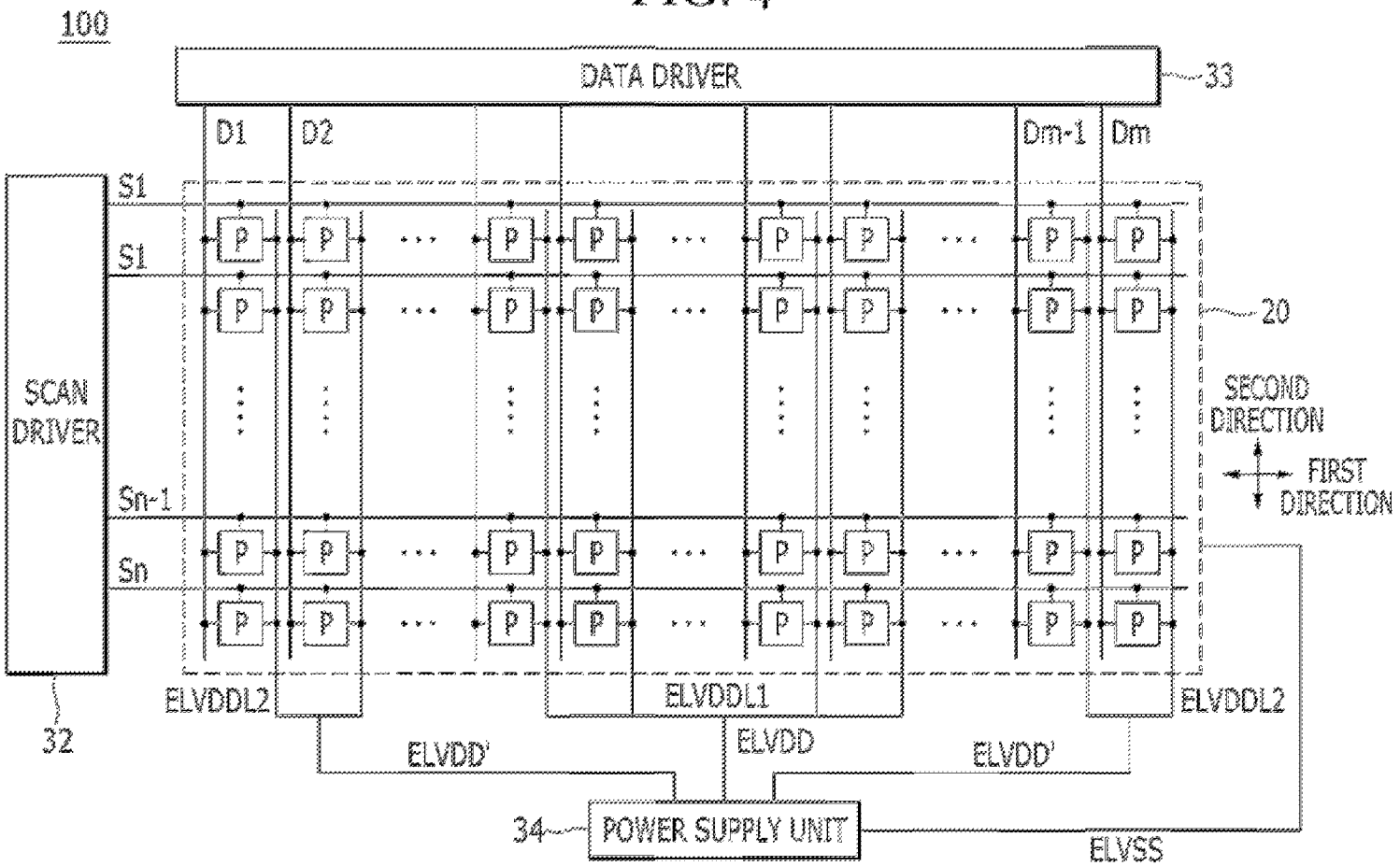
FIG. 4 is a block diagram of the OLED display of FIG. 1, according to exemplary embodiments.

FIG. 4 is a block diagram of the OLED display of FIG. 1, according to exemplary embodiments.

Referring to FIG. 4, the OLED display 100 includes a scan driver 32, scan lines S1-Sn, a data driver 33, data lines D1-Dm, a power supply unit 34, a first driving power line ELVDDL1, a second driving power line ELVDDL2, and the display unit 20. It is noted that "n" and "m" are natural numbers greater than zero and may or may not be equal to one another. The scan driver 32, the data driver 33, and the power supply unit 34 may be components of the controller 30 or may interface with the controller 30. Further, the scan lines S1-Sn, the data lines D1-Dm, the first driving power line ELVDDL1, and the second driving power line ELVDDL2 may be components of the display unit 20.

According to exemplary embodiments, the scan lines S1-Sn are connected to the scan driver 32 and may be formed on the substrate 10. The scan lines S1-Sn may be parallel (or substantially parallel) to one another and may longitudinally extend in a first direction, e.g., a row direction. The scan driver 32 may be configured to supply (e.g., sequentially supply) scan signals to the scan lines S1-Sn in response to control signals supplied from a control circuit (e.g., an external control circuit) (not shown), such as a timing controller. In this manner, the pixels P may be selected based on reception of the scan signals.

The data lines D1-Dm are connected to the data driver 33 and may be formed on the substrate 10. The data lines D1-Dm may be parallel (or substantially parallel) to one another and may longitudinally extend in a second direction, e.g., a column direction. It is noted that the data lines D1-Dm are insulated from the scan lines S1-Sn. In exemplary embodiments, the data driver 33 is configured to supply data signals to the data lines D1-Dm in response to the control signals supplied from the control device (e.g., the timing controller, and/or the like). It is noted that the data signals are supplied to the pixels P selected by the scan signals.

According to exemplary embodiments, the first and second driving power lines ELVDDL1 and ELVDDL2 may be formed on the substrate 10 to be parallel (or substantially parallel) to one another in the second direction. In this manner, the first and second driving power lines ELVDDL1 and ELVDDL2 are insulated from the scan lines S1-Sn. The first driving power lines ELVDDL1 are disposed in association with the flat portion 11 of the substrate 10 and the second driving power lines ELVDDL2 are disposed in association with the curved portion 12 of the substrate 10. The first and second driving power lines ELVDDL1 and ELVDDL2 are connected to the power supply unit 34. The power supply unit 34 is configured to apply (or otherwise supply) a first power source voltage ELVDD to the first driving power lines ELVDDL1, and loads color coordinate correction information from the memory 31 to apply to the second driving power lines ELVDDL2, resulting in a second power source voltage ELVDD' in which the color coordinate correction information is reflected. Further, the power supply unit 34 is configured to apply a third power source voltage ELVSS to all pixels P of the display unit 20.

According to exemplary embodiments, each of the pixels P may be formed in a region surrounded by a scan line Sn, a data line Dm, and a driving power line (e.g., ELVDDL1 or ELVDDL2). The power supply unit 34, the scan driver 32, and/or the data driver 33 may be disposed "outside" the display unit 20 on the substrate 10 in the form of, for example, an integrated circuit. It is contemplated, however, that the power supply unit 34, the scan driver 32, and/or the data driver 33 may be provided on an additional film in the form of an integrated circuit respectively connected to the first and second power supply lines ELVDDL1 and ELVDDL2, the scan lines S1-Sn, and the data lines D1-Dm formed on the substrate 10.

Figure 5A:
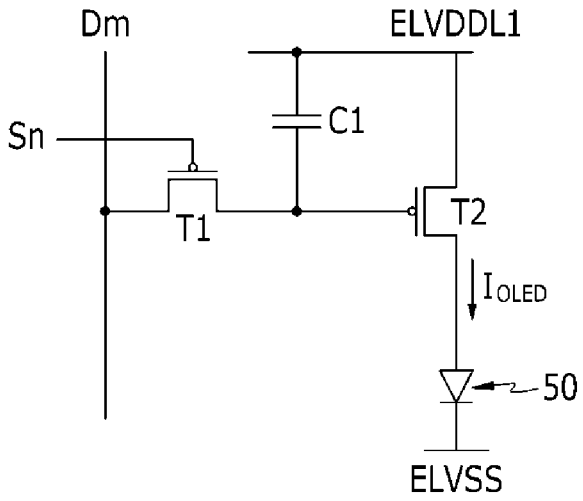
FIGS. 5A and 5B are respective schematic circuit diagrams of corresponding pixels of the OLED display of FIG. 1, according to exemplary embodiments.
Figure 5B:
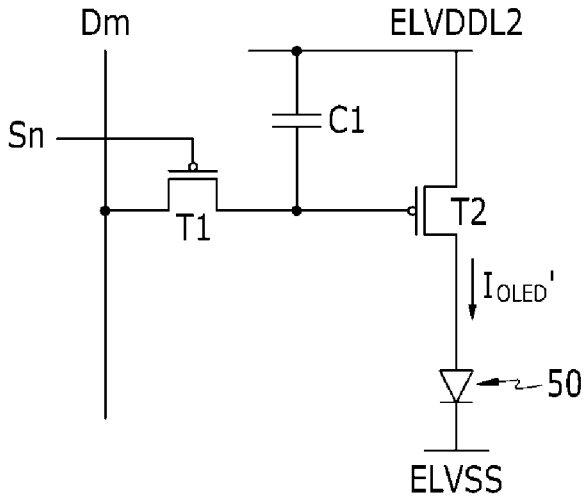
Figure 6:
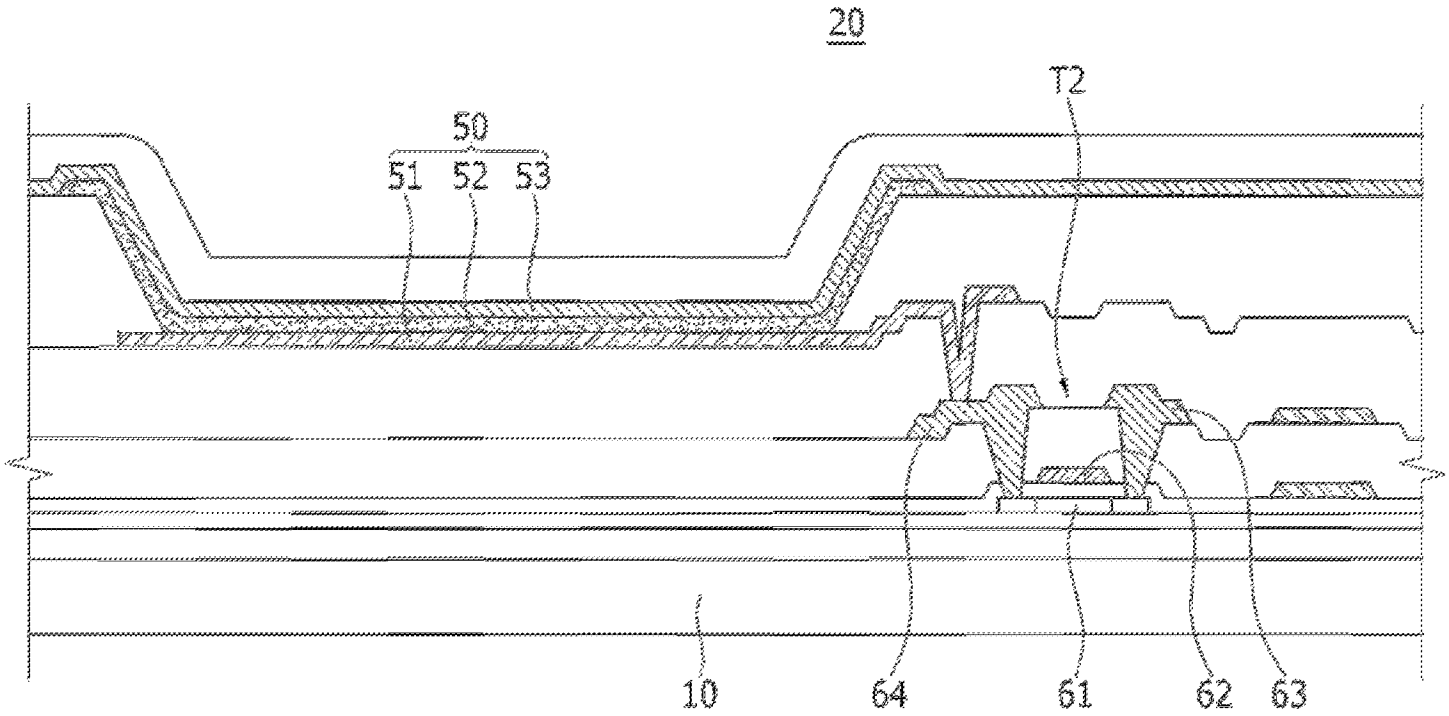
FIG. 6 is a partial, enlarged cross-sectional view of an organic light emitting diode (OLED) of a pixel of the OLED display of FIG. 1, according to exemplary embodiments.

FIGS. 5A and 5B are respective schematic circuit diagrams of corresponding pixels of the OLED display of FIG. 1, according to exemplary embodiments. FIG. 6 is a partial, enlarged cross-sectional view of an organic light emitting diode (OLED) of a pixel of the OLED display of FIG. 1, according to exemplary embodiments. In particular, FIG. 5A is a schematic circuit diagram of a representative pixel P disposed in the flat portion 11 of the OLED display 100, whereas FIG. 5B is a schematic circuit diagram of a representative pixel P disposed in the curved portion 12 of the OLED display 100. The configurations of the OLED and the driving thin film transistor shown in FIG. 6 may be utilized in both the flat portion 11 and the curved portions 12 of the OLED display 100.

Referring to FIGS. 5A, 5B, and 6, each pixel is formed including a pixel circuit and an OLED 50. The pixel circuit includes at least two thin film transistors (e.g., a switching thin film transistor T1 and a driving thin film transistor T2) connected to the scan line Sn, the data line Dm, and the first and second driving power lines ELVDDL1 and ELVDDL2, and at least one capacitor C1. Although FIGS. 5A and 5B include a two transistor, one capacitor configuration, it is contemplated that the respective pixel circuits may include at least three thin film transistors and at least two capacitors. For example, the pixel circuit may include six thin film transistors and two capacitors. In this manner, the OLED display 100 may further include additional scan lines, reset power lines, light emission control lines, and/or the like.

According to exemplary embodiments, the switching thin film transistor T1 includes a first electrode connected to the scan line Sn, a second electrode connected to the data line Dm, and a third electrode configured to transmit a data voltage received via the data line Dm to the driving thin film transistor T2 according to a scan signal received via the scan line Sn. The capacitor C1 includes a first electrode connected to the third electrode of the switching thin film transistor T1 and a second electrode connected to the first driving power line ELVDDL1 (as seen in FIG. 5A) or the second driving power line ELVDDL2 (as seen in FIG. 5B). In this manner, the capacitor C1 is configured to store a voltage corresponding to a voltage difference between the data voltage transmitted from the switching thin film transistor T1 and the power source voltage ELVDD or ELVDD' received via either the first or second driving power line ELVDDL1 or ELVDDL2.

As seen in FIG. 6, the driving thin film transistor T2 includes a semiconductor layer 61, a gate electrode 62, a source electrode 63, and a drain electrode 64. The OLED 50 includes a pixel electrode 51 connected to the drain electrode 64 of the driving thin film transistor T2, a common electrode 53 configured to receive a power source voltage ELVSS applied via the power supply unit 34, and an organic emission layer 52 disposed between the pixel electrode 51 and the common electrode 53. Adverting to FIGS. 5A and 5B, the driving thin film transistor T2 is connected to either the first or the second driving power lines ELVDDL1 or ELVDDL2 and the capacitor C1. In this manner, the driving thin film transistor T2 is configured to provide an output current I_OLED or I_OLED' proportional to, for instance, a square of the voltage difference between the voltage stored in the capacitor C1 and a threshold voltage applied to the pixel electrode 51 of the OLED 50.

According to exemplary embodiments, either the pixel electrode 51 or the common electrode 53 is configured as an anode electrode configured to provide holes to the organic emission layer 52, and the other of the pixel electrode 51 and the common electrode 53 is configured as a cathode electrode configured to provide electrons to the organic emission layer 52. In this manner, excitons may be generated by combining electrons provided from the anode and holes provided from the cathode via the organic emission layer 52. Energy outputted from the excitons emit light. In this manner, the organic emission layer 52 is configured to emit light of a magnitude proportional to an output current supplied to the pixel electrode 51.

Although not illustrated, at least one of a hole injection layer (HIL) and a hole transport layer (HTL) may be disposed between the anode electrode and the organic emission layer 52, and at least one of an electron injection layer (EIL) and an electron transport layer (ETL) may be disposed between the cathode and the organic emission layer 52. The common electrode 53, the HIL, the HTL, the ETL, and the EIL may be formed over the entire (or substantially entire) surface of the display unit 20, and, thereby, may not be divided per pixel P.

It is contemplated that one of the pixel electrode 51 and the common electrode 53 may be formed as a reflective layer, and the other may be formed as a semi-transmissive layer or transparent conductive layer. Light emitted from the organic emission layer 52 may be reflected at the reflective layer and then output through the semi-transmissive layer or the transparent conductive layer. When the semi-transmissive layer is employed, some of the light emitted from the organic emission layer 52 may be re-reflected at the reflective layer, thereby, forming a resonance structure.

According to exemplary embodiments, the OLED display 100 may be configured to divide the driving power lines ELVDDL1 and ELVDDL2 into first driving power lines ELVDDL1 disposed in the flat portion 11 and second driving power lines ELVDDL2 disposed in the curved portions 12. In this manner, the OLED display 100 may be configured to apply the second driving power ELVDD' to which the color coordinate correction information is applied to the second driving power lines ELVDDL2. As such, a corrected output current I_OLED' may be applied to the pixels P disposed in association with the curved portions 12, so that the lateral color coordinates of the pixels P disposed in the curved portions 12 may be equalized (or substantially equalized) with the color coordinates of the pixels P disposed in association with the flat portion 11. In other words, the OLED display 100 may be configured to enable a color of light perceived by an observer from the pixels P disposed in the flat portion 11 to be the same (or substantially the same) as the light perceived by the observer from the pixels disposed in the curved portions 12. As such, the white color of the light "laterally" emitted from the curved portion 12 may be equalized (or substantially equalized) with that of the light "frontally" emitted from the flat portion 11. To this end, the OLED display 100 can minimize (or otherwise reduce_a color quality difference between the flat portion 11 and the curved portions 12 that may otherwise be recognized.

It is also noted that the data driver 33 may be configured to apply a data voltage in which color coordinate correction information is reflected for the data lines Dm disposed in the curved portions 12. In other words, the corrected power source voltage ELVDD' may be provided via the power supply unit 34 disposed in the curved portions 12 to the second driving power lines ELVDDL2, and the corrected data voltage may be supplied from the data driver 33 to the data lines Dm disposed in the curved portions 12. To this end, the data driver 33 may be configured to select the data lines Dm located in the curved portions 12 among the data lines D1-Dm, such that when data signals are generated based on an image signal received from a control circuit, the data driver 33 is configured to load the color coordinate correction information stored in the memory 31 to generate data signals in which the color coordinate correction information is reflected for the pixels P disposed in the curved portions 12. Further, the data driver 33 may be further configured to provide the corrected data signals to the data lines Dm located in the curved portions 12.

Figure 7:
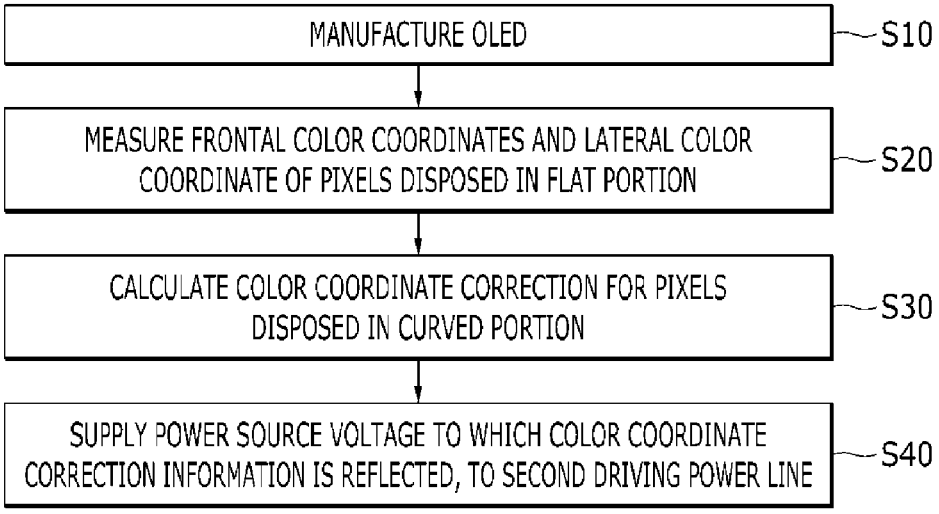
FIG. 7 is a flowchart of an image compensating method, according to exemplary embodiments.

FIG. 7 is a flowchart of an image compensating method, according to exemplary embodiments.

Referring to FIG. 7, at step S10, the OLED display 100 is manufactured including the flat portion 11 and the curved portions 12, in which first driving power lines ELVDDL1 and second driving power lines ELVDDL2 are separately formed to provide data voltages to pixels P respectively disposed in the flat portion 11 and the curved portions 12. At step S20, "frontal" color coordinates and "lateral" color coordinates of the pixels P disposed in association with the flat portion 11 are measured. In step S30, the color coordinate correction information for pixels P disposed in association with the curved portions 12 are determined, so that the "lateral" color coordinates of the pixels P disposed in the curved portions 12 may be equalized (or substantially equalized) with the "frontal" color coordinates of the pixels P disposed in the flat portion 11. Per step S40, the first and second power source voltages ELVDD and ELVDD' are provided via the power supply unit 34, where the color coordinate correction information is reflected in the second power source voltages ELVDD' for the pixels P disposed in the curved portions 12.

In particular, at step S10, the first driving power line ELVDDL1 is formed on the flat portion 11 of the substrate 10, and the second driving power line ELVDDL2 is formed on the curved portion 12 of the substrate 10. The curved portion 12 may be provided at opposite sides of the flat portion 11. In this manner, multiple second driving power lines ELVDDL2 may be provided at the opposite sides of the first driving power lines ELVDDLL At step S20, the digital photometer 41 measures the "frontal" color coordinates and the "lateral" color coordinates of the pixels P disposed in association with the flat portion 11 of the OLED display 100. In this manner, the "lateral" color coordinates may be color coordinates measured at a viewing angle of 45°. The digital photometer 41 may transmit the measured color coordinate data to the correction calculator 42.

Per step S30, the correction calculator 42 calculates the color coordinate correction information for the pixels P disposed in association with the curved portions 12 so that the "lateral" color coordinates of the pixels P disposed in association with the curved portions 12 may be equalized (or substantially equalized) with those of the pixels P disposed in association with the flat portion 11. In this manner, the calculator 42 is configured to using the measured color coordinate data received from the digital photometer 41 as basic information to determine the above-noted color coordinate correction information. The color coordinate correction information calculated (or otherwise determined) via the correction calculator 42 may be transmitted to and stored by the memory 31 of the controller 30.

In step S40, the power supply unit 34 loads the color coordinate correction information stored in the memory 31 to output the second power source voltage ELVDD', in which the color coordinate correction information is reflected, to the second driving power lines ELVDDL2. As such, the color coordinates of the pixels P disposed in association with the curved portions 12 may be controlled so that the white color of light "laterally" emitted from the curved portions 12 may be perceived similarly as of the white color "frontally" emitted from the pixels P disposed in association with the flat portion 11. To this end, a color quality difference between the flat portion 11 and the curved portions 12 may be minimized or otherwise reduced.

Additionally, per step S40, the data driver 33 may be configured to select the data lines Dm disposed in association with the curved portions 12 and load the color coordinate correction information stored in the memory 31 to output a data voltage in which the color coordinate correction information is reflected for the pixels disposed in association with the curved portions 12. In this manner, the data driver may supply the corrected data signals to the data lines Dm disposed in association with the curved portions 12.

According to exemplary embodiments, the OLED display 100 is configured to equalize (or substantially equalize) the white color of light "laterally" emitted from its curved portions 12 with that of light "frontally" emitted from its flat portion 11. As such, exemplary embodiments may enable the minimization of or reduction in a color quality difference between the flat portion 11 and the curved portions 12 that may otherwise be perceived by an observer. To this end, display quality may be increased.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light emitting diode (OLED) display, comprising:

a substrate comprising a flat portion and a curved portion; and a display unit comprising pixels configured to display an image, at least some of the pixels being disposed in association with the flat portion and at least some of the pixels being disposed in association with the curved portion, wherein:

the display unit comprises first driving power lines connected to the pixels disposed in association with the flat portion and second driving power lines connected to the pixels disposed in association with the curved portion;

the first driving power lines are configured to transmit a first power source voltage and the second driving power lines are configured to transmit a second power source voltage, the first power source voltage and the second power source voltage being different;

the first driving power lines and the second driving power lines are connected to a power supply unit; and the power supply unit is connected to a memory configured to store color coordinate correction information; and the color coordinate correction information stored in the memory comprises at least one current-voltage-color coordinate relative function value for a power source voltage.

2. The OLED display of claim 1, wherein the power supply unit is configured to:

receive the color coordinate correction information stored in the memory;

generate a power source voltage based on the color coordinate correction information; and output the power source voltage to the second driving power line.

3. The OLED display of claim 2, wherein the pixels disposed in the curved portion are configured to emit lateral color coordinates substantially equalized with frontal color coordinates emitted by pixels disposed in association with the flat portion based on reception of the power source voltage via the second driving power line.

4. The OLED display of claim 1, further comprising:

first data lines disposed in association with the flat portion;

second data lines disposed in association with the curved portion; and a data driver connected to the first data lines and the second data lines, wherein the data driver is configured to receive the color coordinate correction information stored in the memory.

5. The OLED display of claim 4, wherein the color coordinate correction information stored in the memory further comprises at least one current-voltage-color coordinate relative function value for a data voltage.

6. The OLED display of claim 5, wherein:

the power supply unit is configured to apply a power source voltage to the second driving power lines based on the at least one current-voltage-color coordinate relative function value for a power source voltage; and the data driver is configured to apply a data voltage to a second data line based on the at least one current-voltage-color coordinate relative function value for a data voltage.

7. The OLED display of claim 6, wherein pixels disposed in the curved portion are configured to emit lateral color coordinates substantially equalized with frontal color coordinates emitted by pixels disposed in association with the flat portion based on reception of the power source voltage via the second driving power line and reception of the data voltage via the second data line.

8. An image compensating method, comprising:

determining color coordinate correction information for a first pixel disposed in association with a curved portion of a display device to equalize lateral color coordinates of the first pixel with frontal color coordinates of a second pixel disposed in association with a flat portion of the display device;

supplying a first power source voltage to the second pixel; and supplying a second power source voltage to the first pixel based on the color coordinate correction information, wherein:

the first power source voltage and the second power source voltage are different;

the color coordinate correction information is stored in a memory of the display device;

determining the color coordinate correction information comprises retrieving the color coordinate correction information from the memory, the color coordinate correction information comprising at least one current-voltage-color coordinate relative function value for a power source voltage; and the second power source voltage is supplied to the first pixel via a first driving power line disposed in the curved portion of the display device based on the at least one current-voltage-color coordinate relative function value for a power source voltage.

9. The image compensating method of claim 8, wherein the color coordinate correction information relates to a difference between frontal color coordinates of the second pixel and lateral color coordinates of the second pixel.

10. The image compensating method of claim 8, wherein the color coordinate correction information further comprises at least one current-voltage-color coordinate relative function value for a data voltage.

11. The image compensating method of claim 10, wherein:

the second power source voltage is supplied to the first pixel via a first driving power line disposed in the curved portion of the display device based on the at least one current-voltage-color coordinate relative function value for a power source voltage; and a data voltage is supplied to the first pixel via a first data line disposed in the curved portion of the display device based on the at least one current-voltage-color coordinate relative function value for a data voltage.

12. The method of claim 8, wherein the first power source voltage is supplied to the second pixel via a second driving power line disposed in the flat portion of the display device.

13. The method of claim 11, wherein the first power source voltage is supplied to the second pixel via a second driving power line disposed in the flat portion of the display device.

14. The method of claim 13, wherein another data voltage is supplied to the second pixel via a second data line disposed in the flat portion of the display device.

15. The method of claim 8, further comprising:

measuring the frontal color coordinates of the second pixel;

measuring the lateral color coordinates of the second pixel;

determining the color coordinate correction information based on a difference between the frontal color coordinates of the second pixel and the lateral color coordinates of the second pixel.

16. The method of claim 15, wherein the frontal color coordinates and the lateral color coordinates are measured using a digital photometer.

* * * * *